US008448808B2

(12) United States Patent
Tani et al.

(10) Patent No.: US 8,448,808 B2
(45) Date of Patent: May 28, 2013

(54) PRESSURE VESSEL HAVING IMPROVED SEALING ARRANGEMENT

(75) Inventors: Tatsushi Tani, Sakura (JP); Yoshihiro Watanabe, Sakura (JP); Teruyuki Nakamura, Sakura (JP); Shoji Sato, Sakura (JP)

(73) Assignee: Yachiyo Industry Co., Ltd., Sayama-Shi (JP)

( * ) Notice: Subject to any disclaimer, the term of this patent is extended or adjusted under 35 U.S.C. 154(b) by 232 days.

(21) Appl. No.: 12/939,358

(22) Filed: Nov. 4, 2010

(65) Prior Publication Data

US 2011/0108557 A1 May 12, 2011

(30) Foreign Application Priority Data

Nov. 11, 2009 (JP) ..... 2009-257932

(51) Int. Cl.
*F17C 1/02* (2006.01)

(52) U.S. Cl.
USPC ..... 220/592; 220/586; 220/601

(58) Field of Classification Search
CPC ..... F17C 1/02
USPC ..... 220/586, 601, 661, 592, 582, 587, 220/562
See application file for complete search history.

(56) References Cited

U.S. PATENT DOCUMENTS

| | | | | |
|---|---|---|---|---|
| 5,429,845 | A | 7/1995 | Newhouse et al. | |
| 6,227,402 | B1 | 5/2001 | Shimojima | |
| 6,230,922 | B1 * | 5/2001 | Rasche et al. | 220/586 |
| 7,861,887 | B2 | 1/2011 | Ota et al. | |
| 8,231,028 | B2 * | 7/2012 | Matsuoka et al. | 220/582 |
| 2009/0071930 | A1 | 3/2009 | Sato | |

FOREIGN PATENT DOCUMENTS

| | | | |
|---|---|---|---|
| JP | 6-137433 | A | 5/1994 |
| JP | 8-219389 | A | 8/1996 |
| JP | 11-013995 | A | 1/1999 |
| JP | 2000291887 | A | 10/2000 |
| JP | 2000291888 | A | 10/2000 |
| JP | 2001152653 | A | 12/2001 |
| JP | 2007263290 | A | 10/2007 |
| JP | 2008256151 | A | 10/2008 |
| JP | 2009058111 | A | 3/2009 |

* cited by examiner

*Primary Examiner* — Stephen Castellano
(74) *Attorney, Agent, or Firm* — Marshall & Melhorn, LLC

(57) ABSTRACT

In a pressure vessel (1) comprising a resin liner (2) provided with a tubular extension (22) defining a through hole therein for receiving and expelling the gas or liquid, a tubular member (100, 200, 300) fitted in the through hole of the tubular extension, a mouthpiece (4) threaded into the tubular extension, a fiber reinforced resin layer (3) placed around an outer surface of the resin liner, and a valve (60) fitted into the central bore of the tubular member, the valve include a section (62) having a smaller outer diameter than an opposing inner circumferential surface of the tubular member defining a gap between the valve and tubular member, and a resilient seal member (80) is placed in the gap. The tubular member is made of a material such as metallic material which is stiffer than the resin liner. Thereby, the resilient seal member is interposed between the tubular member and valve which are both highly stiff or free from deformation when the interior of the pressure vessel is placed under various pressure conditions so that the sealing performance of the resilient seal member can be ensured under all pressure conditions.

12 Claims, 4 Drawing Sheets

PRESSURE VESSEL HAVING IMPROVED SEALING ARRANGEMENT

TECHNICAL FIELD

The present invention relates to a pressure vessel having improved sealing arrangement, and in particular to a pressure vessel having improved sealing arrangement which is suitable for storing pressurized gas such as compressed natural gas (CNG) under a high pressure.

BACKGROUND OF THE INVENTION

CNG is considered as a relatively clean source of energy that helps to avoid the global warming, and is expected to be more widely used as automotive fuel in place of more conventional gasoline. However, gas has a lower density than liquid or solid, and is required to be highly compressed to be stored in a limited space available in a motor vehicle or the like. To store compressed gas, a pressure vessel that can withstand a high pressure is required. Steel and aluminum are typical materials for manufacturing a pressure vessel for CNG. A metallic pressure vessel has the advantage of a high mechanical strength and a proven high reliability, but has the disadvantage of being heavy. Therefore, a heavy metallic pressure vessel can be used for a motor vehicle only at the expense of fuel economy and performance of the vehicle.

To overcome this problem, there have been proposals to manufacture a pressure vessel using composite material and thereby reduce the weight of the pressure vessel. Typically, a thin shell container (liner) made of metallic or plastic material is covered by a fiber reinforced layer impregnated with resin, and the resin is allowed to cure. See Japanese patent No. 3523802 (patent document 1), for instance.

In the proposal disclosed in FIG. 2 of patent document 1, a plastic liner is integrally molded with a metallic mouthpiece, and the assembly is covered by a fiber reinforced layer impregnated with resin, followed by the resin curing process. In such an arrangement, there is a possibility that a leak path may be formed in the interface between the mouthpiece and remaining part of the plastic liner. As a leakage through such a leak path cannot be easily repaired after the fiber reinforced layer is placed on the plastic liner, it is highly essential to ensure a reliable sealing of such a potential leak Japanese patent laid open publication No. 2009-58111 (patent document 2) discloses an arrangement for ensuring the sealing of potential leak paths in a pressure vessel before applying a fiber reinforced resin layer. In this proposal, an O-ring is interposed between a metallic mouthpiece and a resin liner. However, as the resin liner deforms in a more pronounced way than the mouthpiece when the interior of the resin liner is pressurized, the sealing performance of the O-ring could be impaired if the deformation of the resin liner is significant.

BRIEF SUMMARY OF THE INVENTION

In view of such problems of the prior art, a primary object of the present invention is to provide a pressure vessel provided with improved sealing arrangement that can maintain the required sealing performance under all pressure conditions.

A second object of the present invention is to provide a pressure vessel provided with improved sealing arrangement that can be assembled easily and in a reliable manner.

According to the present invention, such objects can be accomplished by providing a pressure vessel, comprising: a resin liner defining an interior for receiving gas or liquid and provided with a tubular extension defining a through hole therein for receiving and expelling the gas or liquid into and out of the interior of the resin liner, the tubular extension being formed with a male thread around an outer circumferential surface thereof; a tubular member made of a stiffer material than the resin liner, and having a central bore and fitted in the through hole of the tubular extension; a mouthpiece having a female thread formed on an inner circumferential surface thereof for a threadable engagement with the male thread of the tubular extension; a fiber reinforced resin layer placed around an outer surface of the resin liner; and a valve fitted into the central bore of the tubular member; wherein the valve includes a section having a smaller outer diameter than an opposing inner circumferential surface of the tubular member defining a gap between the valve and tubular member, and a resilient seal member is placed in the gap.

Thereby, the resilient seal member is interposed between the tubular member and valve which are both highly stiff or free from deformation when the interior of the pressure vessel is placed under various pressure conditions so that the sealing performance of the resilient seal member can be ensured under all pressure conditions. Typically, both the valve and tubular member are made of metallic material.

To ensure a firm mechanical attachment and a high sealing action at the interface between the tubular member and tubular extension of the resin liner, an outer circumferential surface of the tubular member may be formed with an annular projection or a plurality of annular projections received or buried in the material of the tubular extension. If desired, a side of at least one of the annular projections facing the interior of the resin liner may be formed with an annular groove for an improved mechanical attachment and sealing performance.

According to a preferred embodiment of the present invention, a free end portion of the valve directed toward the interior of the resin liner includes a first cylindrical portion and a second cylindrical portion connected to a free end side of the first cylindrical portion and having a smaller outer diameter than the first cylindrical portion so that the gap is defined between the second cylindrical portion and opposing inner circumferential surface of the tubular member, the second cylindrical portion being formed with an annular projection on an outer circumferential surface thereof so that the resilient seal member is held in the gap between an annular shoulder surface defined between the first and second cylindrical sections and annular projection.

To ensure a favorably sealing of the interface between the mouthpiece and resin liner, the tubular member may be provided with an external radial flange at an outer axial end thereof, and the mouthpiece may be formed with an annular shoulder surface adjoining an outer axial end of the female thread thereof and facing the interior of the resin liner so as to abut an axial end surface of the external radial flange of the tubular member when the mouthpiece is fully threaded onto the tubular extension. Alternatively, the annular shoulder surface of the mouthpiece may oppose an axial end surface of the external radial flange of the tubular member when the mouthpiece is fully threaded onto the tubular extension so that a resilient seal member may be jointly engaged by the annular shoulder surface and the axial end surface of the external radial flange.

According to a certain aspect of the present invention, an outer surface of the tubular member is covered by a resin layer which is thermally welded to an inner circumferential surface of the tubular extension so that the sealing of the interface between the tubular member and tubular extension may be ensured without any difficulty. Alternatively or additionally, a bonding agent may be interposed between an outer surface of the tubular member and an inner circumferential surface of the tubular extension.

According to a particularly preferred embodiment of the present invention, the mouthpiece is formed with a skirt portion in an end facing the interior of the resin liner, and a complementary recess is formed in a part of the resin liner surrounding the mouthpiece for receiving the skirt portion therein so that outer surfaces of the skirt portion and resin liner jointly form a smooth outer contour. The large surface area of the skirt portion engaging the outer surface of the resin liner contributes to the favorable sealing of the interface between the mouthpiece and resin liner. Furthermore, the combined outer surface of the skirt portion and resin liner can be made highly smooth so that the fiber reinforced resin layer thereon can provide a maximum reinforcing effect when the fiber reinforced resin layer is applied to the combined outer surface of the skirt portion and resin liner.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
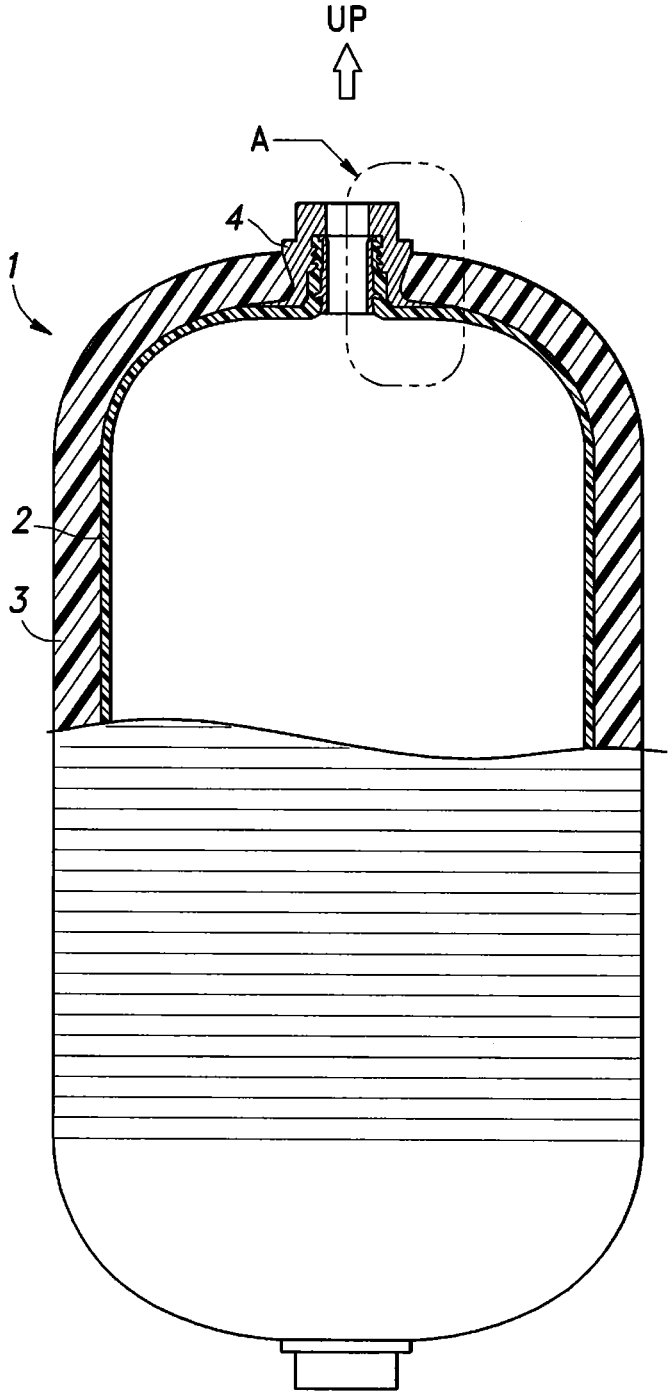
FIG. 1 is a side view of a pressure vessel embodying the present invention partly in section.

FIG. 1 shows a main part of a pressure vessel 1 embodying the present invention. The pressure vessel 1 comprises a resin liner 2 having a cylindrical main part and a pair of semispherical axial end parts, a fiber reinforced resin layer 3 surrounding the outer surface of the resin liner 2, and a mouthpiece 4 fitted to an opening provided in one of the axial end parts of the pressure vessel 1.

The illustrated pressure vessel 1 can be used in any desired orientation, but it is assumed that the pressure vessel 1 is put in an upright position with the mouthpiece 4 on the top as illustrated in the drawings for the purpose of the following description.

The resin liner 2 is made of material suited for contact with the gas or liquid that is to be contained in the pressure vessel 1, and may be selected from various plastic materials, such as polyethylene (PE), high density polyethylene (HDPE), polyamide, polyketone and polyphenylene sulfide (PPS), depending on the kind of material that is to be contained and the internal pressure. The blow molding processes is used for preparing the resin liner 2 in the illustrated embodiment, but other processes such as the rotational molding process may also be used.

The shape of the resin liner 2 essentially determines the final shape of the pressure vessel 1, and is configured to withstand a prescribed pressure with a minimum amount of material. The pressure vessel 1 may have a cylindrical shape as in the illustrated embodiment, but may also be spherical or otherwise shaped so as to be conveniently received in an available compartment of a vehicle having irregular shapes. The blow molding process is suited for preparing resin liners 2 having irregular shapes.

Typically, after the mouthpiece 4 is fitted on the resin liner 2, the reinforcing fibers impregnated with resin is applied to the outer surface of the resin liner 2 and a part of the mouthpiece 4 by a filament winding process. Alternatively, fabric strips impregnated with resin may be applied to the outer surface of the resin liner 2 and a part of the mouthpiece 4 by a hand lay-up process.

The fiber reinforced resin layer 3 may also be considered as fiber reinforced plastic (FRP) that is prepared by forming fibers (or fabric) impregnated with resin into a prescribed shape and then curing the resin, and serves as a primary structural member that provides the main mechanical strength for the pressure vessel 1.

The resin material for the fiber reinforced resin layer 3 typically consists of epoxy resin having a high mechanical strength. When a thermal stability is required, phenol resin may be preferred. The fibers typically consist of high strength and high resiliency fibers such as carbon, glass, silica and aromatic polyamide fibers. Fibers or fabric impregnated with such resin is known as prepreg.

The application of prepreg onto the assembly of the resin liner 2 and mouthpiece 4 can be accomplished either by the filament winding process or the hand lay-up process, but the filament winding process is more suitable for implementing the present invention as the mentioned process can achieve a high mechanical strength owing to the use of highly continuous fibers while allows the thickness of the shell to be minimized. The reinforcing fibers can be wound circumferentially around the resin liner 2 (hoop winding), axially around the resin liner 2 (inline winding) and/or at an angle to the hoop winds (helical winding). The winding methods, winding angles and number of winding turns may be selected so as to suit the particular needs.

Once the prepreg is applied to the resin liner 2, the assembly is placed in a curing oven for a prescribed period of time to let the resin cure.

Figure 2:
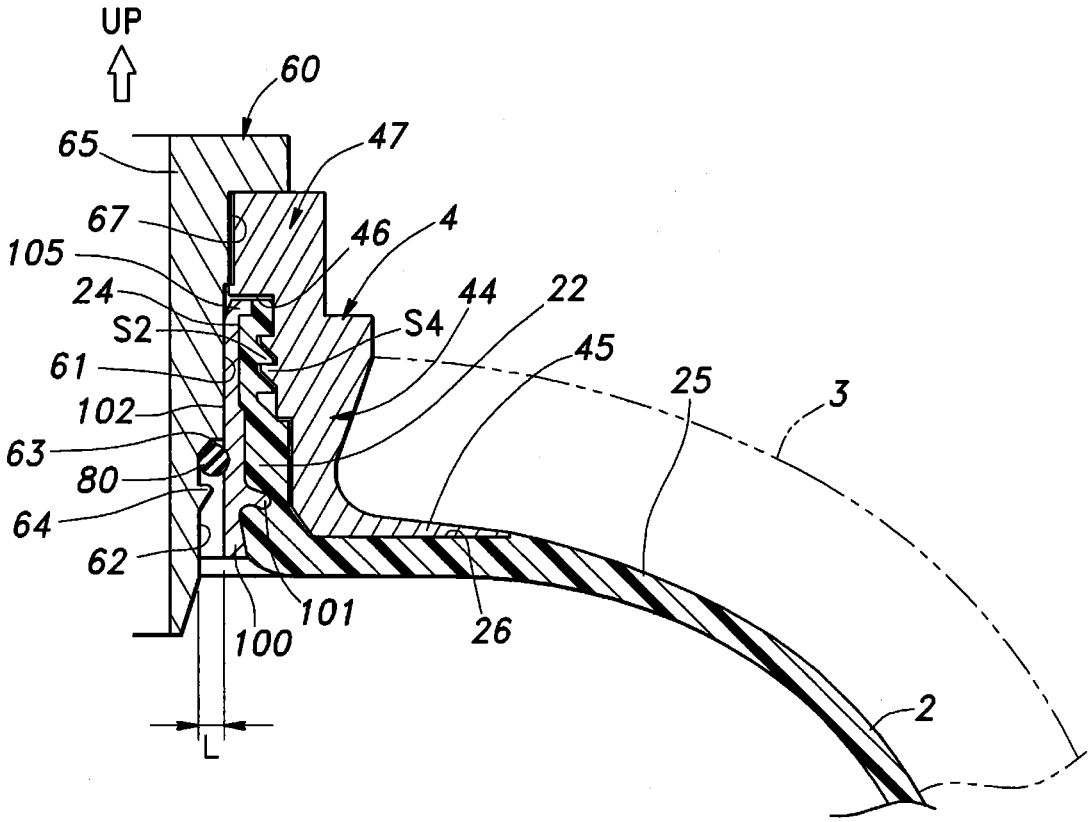
FIG. 2 is an enlarge sectional view of a mouth part of the pressure vessel shown in FIG. 1.

Referring to FIG. 2, the resin liner 2 is formed with a tubular extension 22 extending from an axial end thereof and internally defining a through hole 24 communicating the interior of the resin liner 2 with the exterior thereof. The tubular extension 22 is formed with a male thread S2 on the outer circumferential surface thereof. The outer surface of the part of the resin liner 22 immediately surrounding the lower end of the tubular extension 22 is slightly recessed as denoted with numeral 26.

A tubular member 100 is fitted into the through hole 24 by insert molding. The tubular member 100 includes an annular projection 101 on the outer periphery thereof in the shape of an umbrella protruding into the material of the tubular extension 22, and a central hole 102 that communicates the interior of the resin liner 2 with the exterior. The annular projection 101 not only reinforces the mechanical attachment between the tubular member 100 and resin liner 2 (or tubular extension 22) but also improves the sealing performance for the interface between the tubular member 100 and resin liner 2 (or tubular extension 22). The upper end of the tubular member 100 is provided with an external radial flange 105 having an upper end surface which is substantially flush with the upper end surface of the tubular extension 22. The tubular member 100 is preferably made of material stiffer or more rigid than that of the resin liner 2 (or tubular extension 22), and is typically made of metallic material such as aluminum alloy and stainless steel, but may also be made of high strength plastic material such as epoxy and other thermosetting plastic material.

The mouthpiece 4 includes a tubular main body 44 having a female thread S4 formed in the inner circumferential surface thereof, a skirt portion 45 connected to the lower end of the main body 44 and received in the recessed part 26 of the resin liner 2, and an outer end 47 connected to the upper end of the main body 44 and having a smaller inner diameter than the main body 44. The skirt portion 45 is configured such that the combined outer surface of the skirt portion 45 and the remaining part of the resin liner 2 defines a smooth contour 25. Also, an annular shoulder surface 46 facing downward is formed in the inner circumference of the mouthpiece 4 between the main body 44 and outer end 47 or adjacent to the outer end of the female thread S4. The inner circumferential surface of the outer end 47 is formed with a female thread. The mouthpiece 4 is typically made of metallic material such as aluminum alloy and stainless steel.

The mouthpiece 4 is threadably fitted onto the tubular extension 22 by using the threads S2 and S4 formed in the tubular extension 22 and mouthpiece 4, respectively. The threads may be of any desired configurations, such as the taper thread which has a high sealing performance, and the trapezoidal or acme thread which provides a high mechanical strength. In the latter case, a sealant or sealing member may be used in combination so that a desired sealing performance may be achieved. If desired, a bayonet coupling or other coupling arrangement may be used for joining the mouthpiece 4 to the tubular extension 22.

When the mouthpiece 4 is fully fitted or threaded onto the tubular extension 22, the skirt portion 45 of the mouth piece 4 is received by the recessed part 26 of the resin liner 2 so that the outer surfaces of the skirt portion 45 and resin liner 2 jointly define a smooth outer contour 25 of the assembly. At the same time, the annular shoulder surface 46 of the mouthpiece 4 engages the combined upper end surface of the tubular extension 22 and tubular member 100 so that the metal to metal contact between the annular shoulder surface 46 and tubular member 100 accurately defines the extent of the threading engagement between the mouthpiece 4 and the tubular extension 22.

Once the mouthpiece 4 is assembled to the resin liner 2, the fiber reinforced resin layer 3 is formed on the outer surface of the mouthpiece 4 and resin liner 2 by using any of the known methods. The combined outer surface of the resin liner 2 and mouthpiece 4 on which the fiber reinforced resin layer 3 is applied is free from any irregularities as discussed above so that the reinforcing fibers are enabled to provide a maximum reinforcing effect. The skirt portion 45 abuts the outer surface of (the recessed part 26 of) the resin liner 2 over a large area, and this contributes to a favorable sealing of the interface between the mouthpiece 4 and resin liner 2.

Before or instead of insert molding the tubular member 100 and resin liner 2, a bonding agent may be applied to the outer surface of the tubular member 100. The bonding agent may be a thermo melt bonding agent that melts during the molding process, and solidifies following the molding process so that a bonding agent layer may be interposed between the tubular member 100 and resin liner 2. Such a bonding layer may be effective not only in filling the gap between tubular member 100 and resin liner 2 for sealing but also in withstanding the force caused by the internal pressure of the resin liner 2 that tends to tear the resin liner 2 away from the tubular member 100. Also, the bonding agent layer may have the function to accommodate the difference in the thermal expansion between the tubular member 100 and resin liner 2, and to ensure the sealing between tubular member 100 and resin liner 2 when the interior of the pressure vessel 1 is not pressurized. Thus, the bonding agent layer improves the sealing performance over the entire pressure range to which the pressure vessel 1 may be subjected to. The bonding agent may consist of any suitable bonding agent, but preferably consists of a thermoplastic bonding agent such as a polyolefin bonding agent.

A valve 60 is received in the central opening of the mouthpiece 4, and passed through the central hole 102 of the tubular member 100. The valve 60 is given with a shape of a generally tapering cylinder, and includes, from the top to the bottom, a flanged base portion 65 abutting the outer axial end surface of the outer end 47 of the mouthpiece 4 at a flange thereof, a threaded section 67 threaded into the threaded bore of the mouthpiece 4, a first cylindrical section 61 having a slightly smaller outer diameter than the threaded section 67, a second cylindrical section 62 having a smaller outer diameter that the first cylindrical section 61, in that order. Therefore, a downwardly facing annular shoulder surface 63 is defined between the first and second cylindrical sections 61 and 62. The details of the valve 60, in particular the internal mechanism thereof is omitted from the illustration as it does not form a part of the present invention.

When the valve 60 is threaded into the threaded bore of the mouthpiece 4, the first cylindrical section 61 is closely received by the inner bore 102 of the tubular member 100, and the second cylindrical section 62 defines an annular gap (having a width indicated by L in FIG. 2) in cooperation with the opposing inner circumferential surface of the tubular member 100. An annular projection 64 is formed on the outer circumferential surface of the second cylindrical section 62. An O-ring 80 is received in this annular gap, and is held in position by the annular shoulder 63 and the opposing surface of the annular projection 64. The lower side of the annular projection 64 is less steep than the upper side thereof so that the O-ring 80 may be easily introduced into the prescribed position, but may not be easily dislodged from the prescribed position once placed in the prescribed position. The size of the O-ring 80 is determined so as to be optimally compressed between the outer surface of the second cylindrical section 62 and opposing inner surface of the tubular member 100.

If desired, two or more O-rings may be used. Also, an O-ring having non-circular cross section may be used.

When the pressure vessel 1 is fully assembled, there are five potential leak paths. These leak paths are properly sealed by corresponding sealing arrangements as summarized in the following:

(1) Interface between the valve 60 and tubular member 100 is sealed by the O-ring 80 interposed between the tubular member 100 and valve 60 which are relatively free from deformation during use;

(2) Interface between the tubular member 100 and tubular extension 22 is sealed by insert molding the tubular member 100 with the resin liner 2 with the annular projection 101 of the tubular member 100 providing a self-sealing function;

(3) Interface between the annular shoulder surface 46 of the mouthpiece 4 and the combined end surface of the tubular member 100 and tubular extension 22 is sealed by the abutting engagement between them and/or by using a sealant;

(4) Interface between the inner circumferential surface of the mouthpiece 4 and opposing outer surface of the tubular extension 22 is sealed by the use of a suitable sealing agent; and (5) Interface between the skirt portion 45 of the mouthpiece 4 and the opposing outer surface of the recessed part 26 of the resin liner 2 is sealed by the contact between the two parts over a large area that provides a self-sealing function.

The "self-sealing" as used herein means a mode of sealing that is enhanced by the pressure of the sealed fluid.

Figure 3:
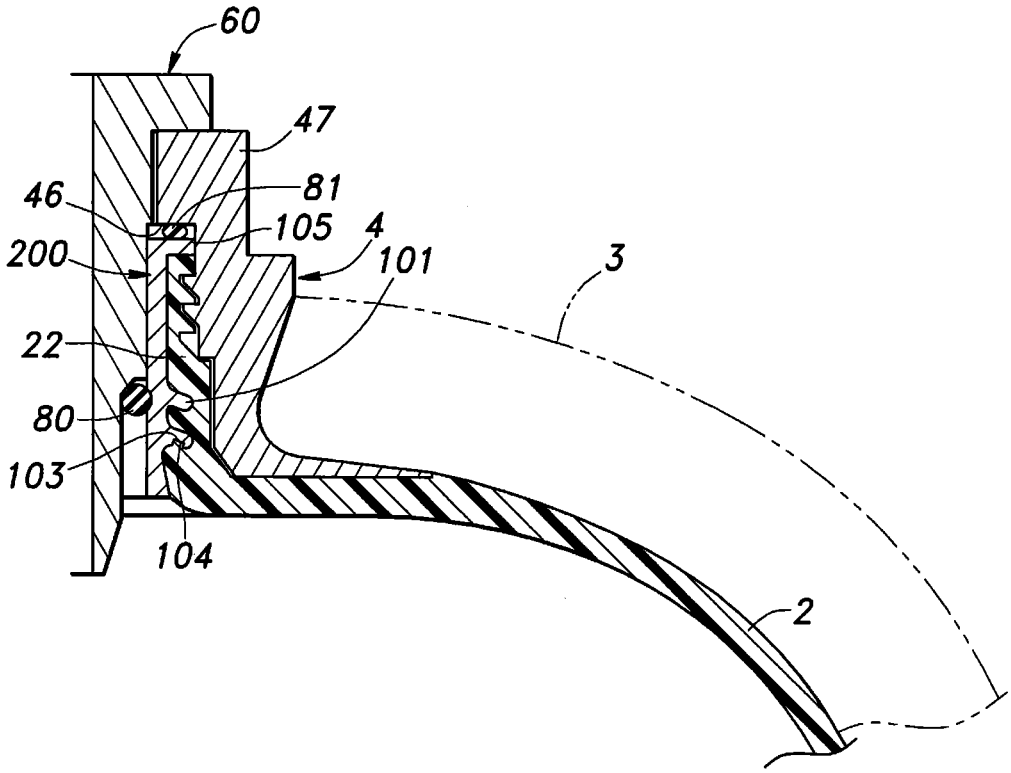
FIG. 3 is a view similar to FIG. 2 showing a second embodiment of the present invention.

FIG. 3 shows a second embodiment of the present invention. In FIG. 3, the parts corresponding to those of the previous embodiment are denoted with like numerals without repeating the description of such parts. In this embodiment, the external radial flange 105 provided in the upper end of the tubular member 200 substantially entirely overlies the upper axial end surface of the tubular extension 22. The annular shoulder 46 of the mouthpiece 4 may abut the upper end surface of the flanged end of the tubular member 200 in a similar way as in the previous embodiment, or an O-ring 81 may be interposed between the annular shoulder 46 and opposing end surface of the flanged end of the tubular member 200 as illustrated in FIG. 3. This O-ring 81 is particularly effective when the internal pressure of the pressure vessel 1 is relatively low, and the self-sealing function is not available.

The tubular member 200 is provided with a pair of annular projections 101 and 103 which protrude into the material of the tubular extension 22. Thereby, the self-sealing feature between the tubular member 200 and tubular extensions 22 and the mechanical attachment between them are even more enhanced. Also, an annular groove 104 is formed in one of the annular projections 103 on the side thereof facing the interior of the resin liner 2 for an improved mechanical attachment and sealing action between the tubular member 200 and tubular extension 22. Such an annular groove 104 may be formed in the single annular projection 101 of the first embodiment.

Thus, the second embodiment differs from the first embodiment in the modes of sealing (2) the Interface between the tubular member 200 and tubular extension 22 by using a pair of annular projections 101 and 103, and (3) the Interface between the annular shoulder surface 46 of the mouthpiece 4 and the combined end surface of the tubular member 100 and tubular extension 22 by using a resilient seal member such as an O-ring.

Figure 4:
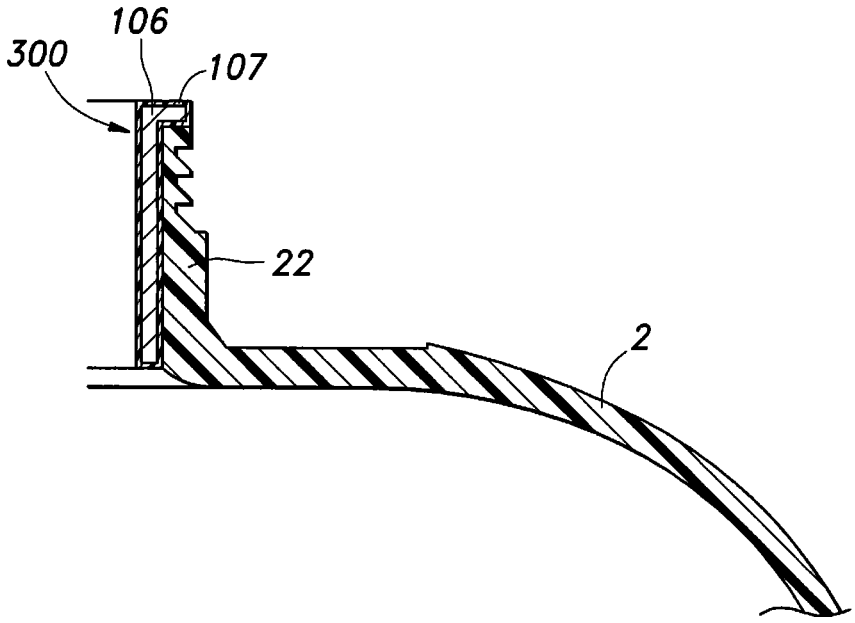
FIG. 4 is a view similar to FIG. 2 showing a third embodiment of the present invention.

FIG. 4 shows a third embodiment of the present invention which differs from the second embodiment only in the structure of the tubular member 300. The third embodiment illustrated in FIG. 4 is otherwise similar to the second embodiment, and the parts in FIG. 4 corresponding to those of FIG. 3 are denoted with like numerals without repeating the description of such parts.

The tubular member 300 in this case comprises a metallic main part 106 having an external radial flange at an upper axial end thereof and a cover layer 107 covering the entire surface of the main part 106 and made of material that can be thermally bonded to the material of the resin liner 2. When the resin liner 2 is made of high density polyethylene (HDPE), the cover layer 107 may consist of polyethylene (PE). HDPE and PE are both thermoplastic, and softens/melts at prescribed high temperatures. In this case, the tubular member 300 may be fitted in the opening of the tubular extension 22 by thermally softening the materials of the cover layer 107 of the tubular member 300 and tubular extension 22 of the resin liner, forcing the tubular member 300 into the opening of the tubular extension 22, and allowing the assembly to cool off. This bonding process may be performed either during the insert molding process or as a part of a separate bonding process. The outer diameter of the tubular member 300 is properly selected in relation to the inner diameter of the opening of the tubular extension 22 so that the two parts are firmly joined to each other at the interface 108 thereof once of the materials of the cover layer 107 and tubular extension 22 have cooled and solidified.

By thus thermally welding the tubular member 300 and the tubular extension 22, the two parts are firmed joined to each other in such a manner that the interface 108 between them is totally air tight. According to this embodiment, the leak path (2) or the interface 108 between the tubular member 300 and tubular extension 22 is sealed by the welding between the cover layer 107 of the tubular member 300 and the tubular extension 22 of the resin liner 2.

As a modification of the third embodiment, the tubular member 300 with or without the cover layer 107 may be fitted in the through hole 24 while applying a bonding agent in the interface 108. Any bonding agent may be used, but polyolefin bonding agents are preferred as they provide a favorable mechanical bonding strength and a required air tightness. An improved bonding strength may be achieved by first applying a primer on the surface of the tubular member 300 which is made of metallic material (or has a metallic surface) in this case, and then applying an epoxy bonding agent over the primer. Such an arrangement ensures a secure mechanical bonding between the tubular member 300 and tubular extension 22, and this ensures the sealing performance of the bonding agent. The bonding agent may also serve the purpose of accommodating the difference in the thermal expansion of the tubular member 300 and tubular extension 22.

Although the present invention has been described in terms of a preferred embodiment thereof, it is obvious to a person skilled in the art that various alterations and modifications are possible without departing from the scope of the present invention which is set forth in the appended claims. The contents of the original Japanese patent application on which the Paris Convention priority claim is made for the present application as well as those of the prior art references cited in the application are incorporated in this application by reference.

The invention claimed is:

1. A pressure vessel, comprising:

a resin liner defining an interior for receiving gas or liquid and provided with a tubular extension defining a through hole therein for receiving and expelling the gas or liquid into and out of the interior of the resin liner, the tubular extension being formed with a male thread around an outer circumferential surface thereof;

a tubular member made of a stiffer material than the resin liner, and having a central bore and fitted in the through hole of the tubular extension;

a mouthpiece having a female thread formed on an inner circumferential surface thereof for a threadable engagement with the male thread of the tubular extension;

a fiber reinforced resin layer placed around an outer surface of the resin liner; and a valve fitted into the central bore of the tubular member;

wherein the valve includes a section having a smaller outer diameter than an opposing inner circumferential surface of the tubular member defining a gap between the valve and tubular member, and a resilient seal member is placed in the gap, and wherein an outer circumferential surface of the tubular member is formed with an annular projection received in a material of the tubular extension.

2. The pressure vessel according to claim 1, wherein the tubular member is made of metallic material.

3. The pressure vessel according to claim 1, wherein an outer circumferential surface of the tubular member is formed with two or more annular projections received in a material of the tubular extension.

4. The pressure vessel according to claim 1, wherein a free end portion of the valve directed toward the interior of the resin liner includes a first cylindrical portion and a second cylindrical portion connected to a free end side of the first cylindrical portion and having a smaller outer diameter than the first cylindrical portion so that the gap is defined between the second cylindrical portion and opposing inner circumferential surface of the tubular member, the second cylindrical portion being formed with an annular projection on an outer circumferential surface thereof so that the resilient seal member is held in the gap between an annular shoulder surface defined between the first and second cylindrical sections and annular projection.

5. The pressure vessel according to claim 1, wherein the tubular member is provided with an external radial flange at an outer axial end thereof, and the mouthpiece is formed with an annular shoulder surface adjoining an outer axial end of the female thread thereof and facing the interior of the resin liner so as to abut an axial end surface of the external radial flange of the tubular member when the mouthpiece is fully threaded onto the tubular extension.

6. The pressure vessel according to claim 1, wherein the tubular member is provided with an external radial flange at an outer axial end thereof, and the mouthpiece is formed with an annular shoulder surface adjoining an outer axial end of the female thread thereof and facing the interior of the resin liner so as to oppose an axial end surface of the external radial flange of the tubular member when the mouthpiece is fully threaded onto the tubular extension and engage a resilient seal member jointly by the annular shoulder surface and the axial end surface of the external radial flange.

7. The pressure vessel according to claim 1, wherein a bonding agent is interposed between an outer surface of the tubular member and an inner circumferential surface of the tubular extension.

8. The pressure vessel according to claim 1, wherein the mouthpiece is formed with a skirt portion in an end facing the interior of the resin liner, and a complementary recess is formed in a part of the resin liner surrounding the mouthpiece for receiving the skirt portion therein so that outer surfaces of the skirt portion and resin liner jointly form a smooth outer contour.

9. The pressure vessel according to claim 8, wherein the fiber reinforced resin layer is applied to a combined outer surface of the skirt portion and resin liner.

10. A pressure vessel, comprising:

a resin liner defining an interior for receiving gas or liquid and provided with a tubular extension defining a through hole therein for receiving and expelling the gas or liquid into and out of the interior of the resin liner, the tubular extension being formed with a male thread around an outer circumferential surface thereof;

a tubular member made of a stiffer material than the resin liner, and having a central bore and fitted in the through hole of the tubular extension;

a mouthpiece having a female thread formed on an inner circumferential surface thereof for a threadable engagement with the male thread of the tubular extension;

a fiber reinforced resin layer placed around an outer surface of the resin liner; and a valve fitted into the central bore of the tubular member;

wherein the valve includes a section having a smaller outer diameter than an opposing inner circumferential surface of the tubular member defining a gap between the valve and tubular member, and a resilient seal member is placed in the gap, and wherein a bonding agent is interposed between an outer surface of the tubular member and an inner circumferential surface of the tubular extension.

11. A pressure vessel, comprising:

a resin liner defining an interior for receiving gas or liquid and provided with a tubular extension defining a through hole therein for receiving and expelling the gas or liquid into and out of the interior of the resin liner, the tubular extension being formed with a male thread around an outer circumferential surface thereof;

a tubular member made of a stiffer material than the resin liner, and having a central bore and fitted in the through hole of the tubular extension;

a mouthpiece having a female thread formed on an inner circumferential surface thereof for a threadable engagement with the male thread of the tubular extension;

a fiber reinforced resin layer placed around an outer surface of the resin liner; and a valve fitted into the central bore of the tubular member;

wherein the valve includes a section having a smaller outer diameter than an opposing inner circumferential surface of the tubular member defining a gap between the valve and tubular member, and a resilient seal member is placed in the gap, and wherein the tubular member is provided with an external radial flange at an outer axial end thereof, and the mouthpiece is formed with an annular shoulder surface adjoining an outer axial end of the female thread thereof and facing the interior of the resin liner so as to abut an axial end surface of the external radial flange of the tubular member when the mouthpiece is fully threaded onto the tubular extension.

12. A pressure vessel, comprising:

a resin liner defining an interior for receiving gas or liquid and provided with a tubular extension defining a through hole therein for receiving and expelling the gas or liquid into and out of the interior of the resin liner, the tubular extension being formed with a male thread around an outer circumferential surface thereof;

a tubular member made of a stiffer material than the resin liner, and having a central bore and fitted in the through hole of the tubular extension;

a mouthpiece having a female thread formed on an inner circumferential surface thereof for a threadable engagement with the male thread of the tubular extension;

a fiber reinforced resin layer placed around an outer surface of the resin liner; and a valve fitted into the central bore of the tubular member;

wherein the valve includes a section having a smaller outer diameter than an opposing inner circumferential surface of the tubular member defining a gap between the valve and tubular member, and a resilient seal member is placed in the gap, and wherein a free end portion of the valve directed toward the interior of the resin liner includes a first cylindrical portion and a second cylindrical portion connected to a free end side of the first cylindrical portion and having a smaller outer diameter than the first cylindrical portion so that the gap is defined between the second cylindrical portion and opposing inner circumferential surface of the tubular member, the second cylindrical portion being formed with an annular projection on an outer circumferential surface thereof so that the resilient seal member is held in the gap between an annular shoulder surface defined between the first and second cylindrical sections and annular projection.

* * * * *